United States Patent [19]

Chang

[11] Patent Number: 4,776,096

[45] Date of Patent: Oct. 11, 1988

[54] SCISSORS MEANS PARTICULARLY FOR CUTTING BLIND'S SLATS

[76] Inventor: A-Shien Chang, No. 6, Lane 722, Yen Hai Road, Fu Nan Ts'un, Fu Hsing Hsiang, Changhua Hsien, Taiwan

[21] Appl. No.: 947,758

[22] Filed: Dec. 29, 1986

[51] Int. Cl.[4] ..... B26B 13/00

[52] U.S. Cl. ..... 30/233; 30/231; 30/229

[58] Field of Search ..... 30/233, 231, 229, 241; 33/334

[56] References Cited

U.S. PATENT DOCUMENTS

| | | | |
|---|---|---|---|
| 3,840,989 | 10/1974 | Hexdall | 30/233 X |
| 4,227,305 | 10/1980 | Newman | 30/233 X |
| 4,428,124 | 1/1984 | Asakuwa | 30/233 X |

*Primary Examiner*—Frank T. Yost
*Assistant Examiner*—Willmon Fridie, Jr.
*Attorney, Agent, or Firm*—Browdy & Meimark

[57] ABSTRACT

The present disclosure is related to a scissors means which is particularly adopted to cut Venetian blind slats into standard sizes, and is characterized by its readiness and precision of operation.

4 Claims, 1 Drawing Sheet

SCISSORS MEANS PARTICULARLY FOR CUTTING BLIND'S SLATS

SUMMARY OF THE PRESENT INVENTION

The present invention is concerned with a scissors means for cutting blind's slats into proper fixed length, and more particularly referred to a cutting means provided with an adjustable measurement ruler so that Venetian blind slats can be orderly and readily cut into a selected standardard length for installation purpose.

Generally Venetial blinds are produced in standard sizes, but various sizes may be needed to meet particular purposes, so that remodeling steps are usually taken to achieve the fittings by cutting the blind's structure into proper size, including the plurality of blind slats thereof; the cutting of a blind's frame structure is not difficult at all, but managing a plurality of blind slats one by one is tedious and time consuming and often results in poor cuttings, i.e., irregular in shape, damaging the artistic appearance of the Venetian blind.

Viewing the disadvantages and shortcomings associated with the conventional method of remodeling Venetian blind slats, the inventor of the present invention has devoted his experience of years in fabricating Venetian blind to creating a simple, effective and precise cutting means to solve an old problem.

The primary object of the present invention is to provide a simply-structured, readily and precisely operable scissors means used in cutting blind slats into a selected length.

The further object of the present invention is to provide a scissors means particularly adapted for cutting oversize blind slats into an identical size for remodeling a Venetian blind into a particular size according to practical need.

With the help of the accompanying drawings, features and operation modes of the scissors means of the present invention are better illustrated, in which:

DETAILED DESCRIPTION OF THE PREFERRED EMBODIMENT

Figure 1:
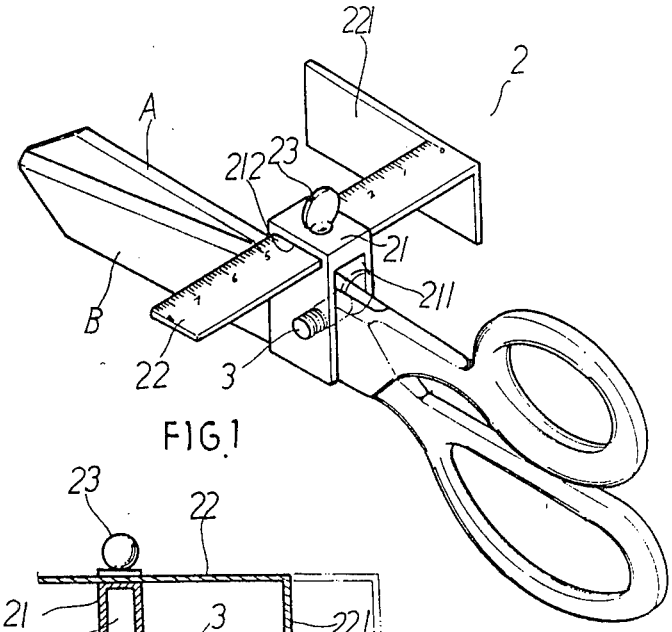
FIG. 1 is the perspective view of the present invention.
Figure 2:
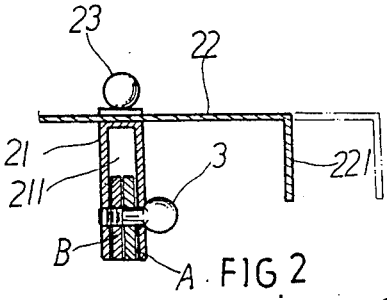
FIG. 2 is a sectional view of the present invention.

As shown in FIG. 1, the scissors means of the present invention, adapted for remodeling Venetian blind slats into proper length, consists of a measurement ruler means 2 equipped with a pair of scissors blades A, B which are bound together by a bolt 3 to form a common scissors, wherein said measurement ruler means 2 is made up of a straight ruler 22 having a stop plate 221 fixedly attached at the right end thereof, and a slidable locking element 21 along said ruler 22, which has a groove opening 211 at the bottom for receiving therein a pair of scissors blades bound together by a bolt 3 which is located through two screw holes on the walls of said groove opening, and said straight ruler is located through a lateral opening 212 on the top of said locking element 21 and be fixed at a selected position by an adjusting screw 23 so that proper length can be selected for a Venetian blind slat to be cut, as shown in FIG. 2.

Figure 3:
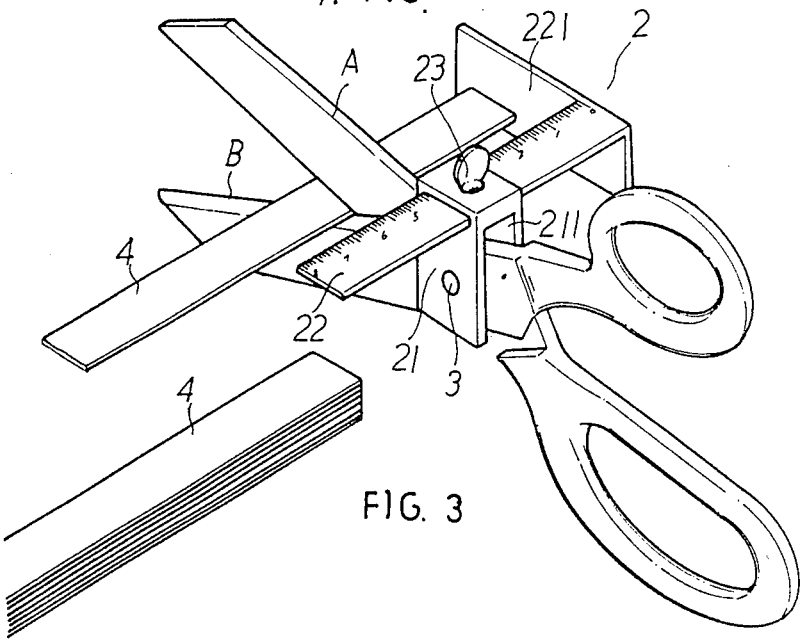
FIG. 3 is a perspective view of the scissors means in operation.

Continuing to refer to FIG. 3, the straight ruler 22 a first adjusted to move to the right or left so that a selected length is fixed between said scissors blade A and said stop plate 221 for an elongate Venetian blind slat which is located with its right end bearing against said stop plate 221 to define the proper length thereof so that the located slat can be cut into preset size by simply actuating the scissors.

Summing up, the scissors means of the present invention, provided with a slideable straight ruler, is designed specially for effecting quick remodeling a plurality of Venetian blind slats by cutting them into selected size, and characterized in its simple structure, ready and precise operability.

I claim:

1. A driver for cutting slats, such as slats for Venetian blinds, comprising a ruler means including a straight ruler having means indicated thereon for indicating length along said straight ruler with said ruler to be located in a position parallel to the slats to be cut;

a stop plate integrally attached on one end of said straight ruler;

a slidable element slidable along said straight ruler toward and away from said stop plate;

scissors having a first blade and a second blade connected at a pivot point of both said blades;

said slidable element including a lateral portion resting on said straight ruler, a pair of arms extending from said lateral portion, bolt means extending through one of said pair of arms, said first and second blades, and the other of said pair of arms respectively to pivotally connect said first and second blades to said arms, locking means mounted on said lateral portion to lock said slidable element in a position along said straight ruler.

2. The device of claim 1 for cutting slats wherein said locking means includes screw means having a hole in said lateral portion through which it extends to exert pressure on said straight ruler.

3. The device of claim 2 for cutting slats wherein said lateral portion includes an oblong hole for receiving said straight ruler therethrough with said screw means extending through its said hole perpendicular to said straight ruler.

4. The device of claim 1 for cutting slats wherein said first and second blades are both pivotally movable relative to said pair of arms.

* * * * *